US005546869A

United States Patent [19]

Nassar

[11] Patent Number: 5,546,869

[45] Date of Patent: Aug. 20, 1996

[54] LIGHTWEIGHT RAILCAR TRUCK SIDEFRAME WITH INCREASED RESISTANCE TO LATERAL TWISTING

[75] Inventor: Rami V. Nassar, Chicago, Ill.

[73] Assignee: AMSTED Industries Incorporated, Chicago, Ill.

[21] Appl. No.: 501,998

[22] Filed: Jul. 13, 1995

[51] Int. Cl.[6] ..... B61F 5/52

[52] U.S. Cl. ..... 105/206.1

[58] Field of Search ..... 105/206.1, 206.2, 105/218.1, 218.2, 220, 222, 224.1

[56] References Cited

U.S. PATENT DOCUMENTS

| | | | |
|---|---|---|---|
| 1,081,405 | 12/1913 | Richards | 105/220 |
| 1,191,979 | 7/1916 | McKeen, Jr. | 105/206.1 X |
| 4,351,242 | 9/1982 | Irwin | 105/206.2 |
| 5,410,968 | 5/1995 | Hawthorne et al. | 105/206.1 |

FOREIGN PATENT DOCUMENTS

| | | | |
|---|---|---|---|
| 2435660 | 4/1980 | France | 105/206.1 |

*Primary Examiner*—Robert J. Oberleitner
*Assistant Examiner*—Kevin D. Rutherford
*Attorney, Agent, or Firm*—Edward J. Brosius; F. S. Gregorczyk; Stephen J. Manich

[57] ABSTRACT

A lightweight sideframe having a solid and open, unitary cross-sectional I-beam shape, is structurally improved by strengthening both sides of the sideframe with cross-bracing at each pedestal jaw area. The cross-bracing laterally stiffens the sideframe, eliminating the succeptability to twisting of the I-beam shape when a transverse load is experienced. The increased lateral stiffness at the jaw area also strengthens the total lateral strength of the sideframe, allowing some removal of metallic mass from the sideframe spring seat plate. The improved lateral sideframe strength also contributes to an increase in the threshold speed of truck hunting.

7 Claims, 2 Drawing Sheets

FIG. 1
PRIOR ART
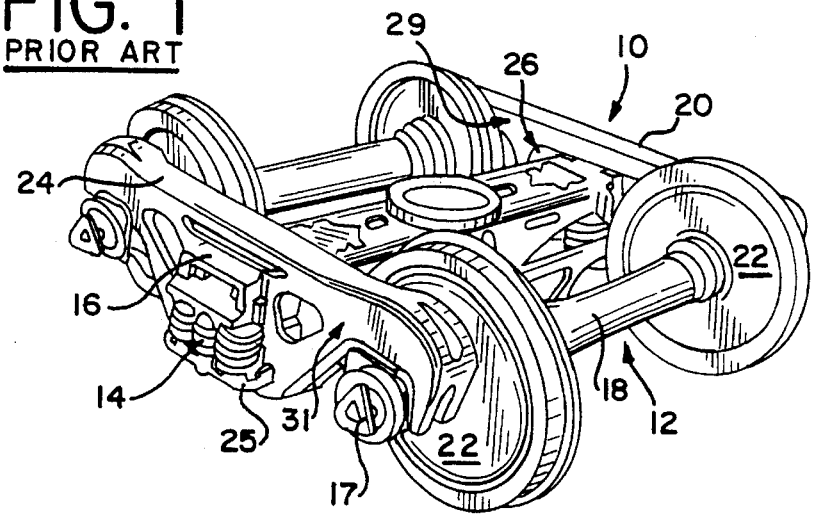
FIG. 3
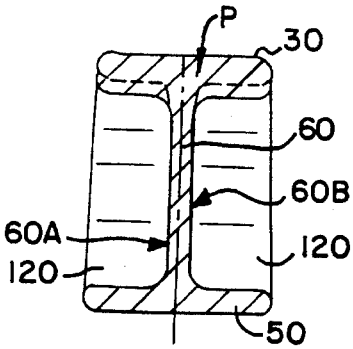
FIG. 4
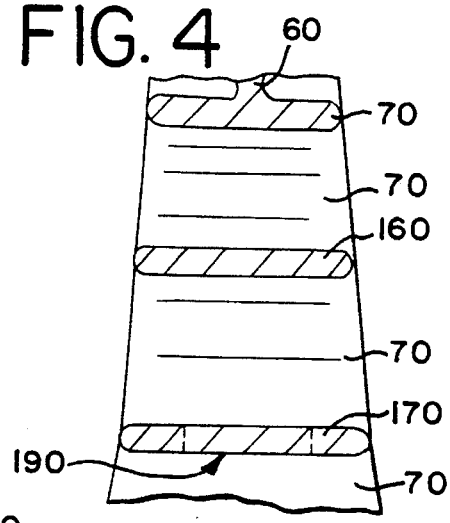
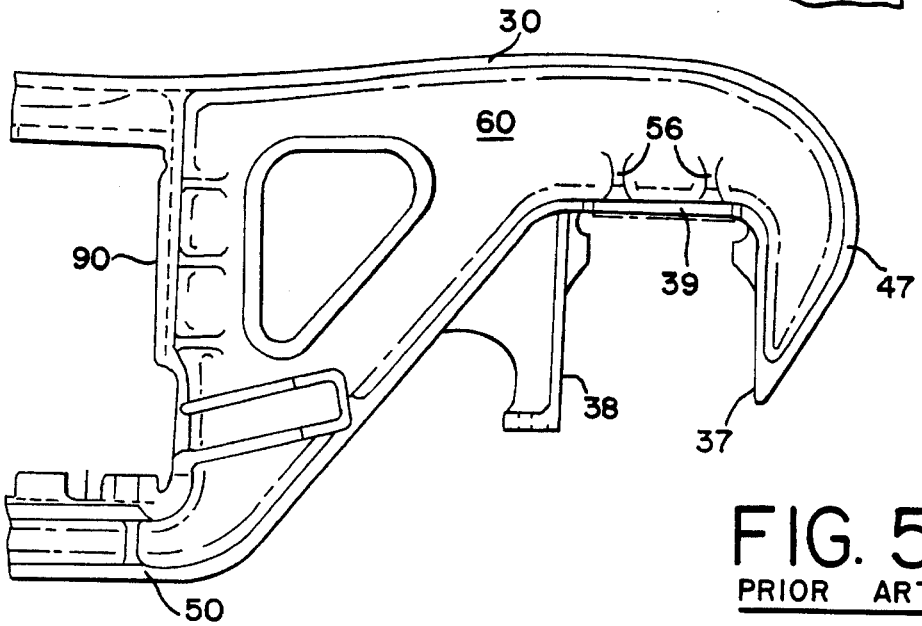
FIG. 5
PRIOR ART

LIGHTWEIGHT RAILCAR TRUCK SIDEFRAME WITH INCREASED RESISTANCE TO LATERAL TWISTING

FIELD OF THE INVENTION

This invention relates to an improved railcar truck and more particularly, to an improved lightweight sideframe for a three-piece freight car truck which exhibits increased resistance to transverse loading, allowing additional metallic mass to be removed from the sideframe.

BACKGROUND OF THE INVENTION

The more prevalent freight railcar construction in the United States includes what are known as three-piece trucks. Trucks are wheeled structures that ride on tracks and two such trucks are normally used beneath each railcar body, one truck at each end. The term "three-piece" refers to a truck that has two sideframes which are positioned parallel to the wheels and the rails, and to a single bolster which transversely spans the distance between the sideframes. The weight of the railcar is generally carried by a center plate connected at the lateral midpoint on each of the bolsters.

Each cast steel sideframe is usually a single casting comprised of an elongated lower tension member interconnected to an elongated top compression member which has pedestal jaws depending downwardly from each end. The jaws are adapted to receive wheeled axles which extend transversely between the spaced sideframes. A pair of longitudinally-spaced internal support columns vertically connect the top and bottom members together to form a bolster opening which receives the truck bolster. The bolster is typically constructed as single cast steel section and each end of the bolster extends into each of the sideframe bolster openings. Each end of the bolster is then supported by a spring group that rests on a horizontal extension plate projecting from the bottom tension member.

Railcar trucks operate in severe environments where the static loading can be significantly magnified, therefore, they must be structurally strong enough to support the car, its payload, and the weight of its own structure. The trucks themselves are heavy structural components which contribute to a substantial part of the total tare weight placed upon the rails. The maximum quantity of product that a shipper may place within a railcar will be directly affected by the weight of the car body, including the trucks themselves. Hence, any weight reduction that may be made in the truck components will be directly available for increasing the carrying capacity of the car.

The designers of the early cast steel trucks experimented with several types of cross sections in their quest to reduce sideframe weight, but were unable to develop a successful "open" cross-section. Modern cast steel sideframes of the current three-piece truck configuration, are rather heavy due to the sideframe designs requiring cross sections of either box or C-shape. Furthermore, producing these types of cross sections requires numerous cores in the casting mold, which increases production costs and complicates the pouring process by adding complex channels inside the mold which must be filled with molten metal.

Fabricated sideframes were later seen as a revolutionary light weight replacement for the cast sideframe, but the presence of welds were found to reduce fatigue life and structural integrity of the sideframe. As a result of the low service life for fabricated sideframes, interest in the cast steel sideframes continued.

A more recent problem hindering the development of lighter and stronger sideframes is the fact that structural re-development of a cast steel sideframe design is extremely expensive, and it requires the approval of the American Association of Railroads (AAR) before the new design can become field-operational. The AAR review and approval process can take months, even years; for a complex design change. Therefore, it is not surprising that innovation in the railroad industry has proceeded slowly in the freight car truck design area. In spite of these handicaps, new analytical tools and a genuine need to help the railroads reduce costs is now at hand. The great strides made in development of computer technology and advanced engineering analysis has allowed sideframe designers to challenge old sideframe design principles and to design new sideframe members which are stronger, yet actually lighter than past designs. These latest techniques have increased the focus of attention towards maximizing the carrying capacity of the car while reducing the energy consumption realized from weight reductions in the railcar components.

Recent sideframe developments have concentrated on structurally re-designing the sideframe from the closed and box-type of cross-section, into an open, and I-beam shaped cross-section. A challenging new sideframe design of this type is described in U.S. Pat. No. 5,410,968 issued May 2, 1995 and assigned to AMSTED Industries Incorporated, Chicago, Ill., co-owner of the present application. The sideframe of that application provides an integrally cast I-beam shaped, solid sideframe in which the upper and lower compression and tension members comprise the flanges of the I-beam, while a vertical web interconnects the flanges together. Although a portion of the web is removed to reduce weight, a substantial weight savings is realized from the solid component construction, as compared to an open, box-type sideframe. By directing molten metal only to critical stress areas of the sideframe, weight savings between 200–250 pounds per sideframe can be realized. The range of weight savings is a function of the tonnage rating of the truck, i.e., 100 ton or 125 ton. Besides the advantages of saving weight, the solid, yet "open" I-beam structure provides that all sideframe surfaces will be in open, plain view for easy inspection. Prior art box-like sideframes have inside surfaces that are never in plain view and can never be visually inspected. This "open" feature provided several production and quality-related advantages over prior art sideframes.

As previously mentioned, all new railroad component design changes must be officially tested, verified, and then approved by the AAR before ever being placed into actual field use. One shortfall has been discovered with the sideframe of U.S. Pat. No. 5,410,968 when subjected to the "official" AAR transverse test methods; namely, inconsistent test results which have subjected some of the sideframes to failure of the static AAR transverse load tests. Those in the art are familiar with the AAR method of transverse testing wherein the sideframe is layed flat on one of its sides (see FIG. 2) and is supported and elevated at each sideframe end, or pedestal jaw, by a respective stationary post (not shown). The posts are secured to the ground. A clamp 300 and a steel bar 400 is then connected to each of the sideframe pedestal jaws, such that the clamp and bar extend between each of the supporting posts; a dial indicator 500 is attached to the midpoint of the bar. A vertical, downward test load is applied to the midsection of the sideframe, causing it to deflect and the dial indicator measures the total amount of static deflection. Under the AAR standards, a limited amount of deflection is allowed. Because the steel bar is directly connected to the sideframe at each pedestal jaw, the AAR transverse loading arrangement is considered a "floating-zero" type of measuring method since the test equipment (steel bar and dial indicator) is effectively "floating" with respect to the deflection in the sideframe. However, railcar designers typically use a fixed or "ground-zero" transverse testing method which is essentially similar to the AAR test method, except that the dial indicator is attached in a stationary position on the ground and is not allowed to "float". It is felt that this method of measurement is more representative of the true deflection than the AAR floating method.

When a transverse test load was applied to the lightweight sideframe of U.S. Pat. No. 5,410,968, using the AAR test method; the distal ends of the sideframe were found to slightly twist in the same longitudinal direction as the test bar. This lateral twisting behavior is expected at the sideframe ends since an I-beam construction is inherently susceptible to twisting. However, the twisting movements of the sideframe ends cause twisting in the test bar itself, and hence twisting of the "floating" dial indicator. The non-stationary dial indicator arrangement was found to create inconsistent and unreliable test results, leading to occasional non-compliance with the AAR transverse test standards. It is important to note that during actual operating conditions, twisting of the distal sideframe ends will not be as pronounced as during the AAR transverse tests since the axles will secure the sideframe ends against such movement and since this type of movement only occurs during truck curving or high speed truck hunting. Moreover, it should also be clarified that when the same transverse tests were performed using the "ground-zero" measuring methods, the sideframes easily satisfied all of the AAR transverse static load test standards. Even though the ground-zero test is widely accepted and used within the industry during in-house testing, the AAR transverse test methods currently control. Therefore, in order for the above-mentioned sideframe to become fully sanctioned according to AAR methods and standards, it was realized a lateral sideframe structure which could prevent the twisting of the "floating" dial indicator was needed.

SUMMARY OF THE INVENTION

To this end, one object of the present invention is to laterally strengthen the I-beam shaped sideframe ends.

It is a related object of the present invention to decrease the structural warping of the sideframe by increasing the sideframe rotational resistance, thereby increasing the threshold speed of truck hunting.

It is another object of the present invention to increase the overall lateral sideframe strength, thereby allowing removal of metallic mass at the sideframe midsection.

It is a final object of the present invention to increase the lateral sideframe stiffness such that consistent AAR transverse loading tests can be satisfied.

Briefly stated, the present invention involves adding cross bracing means on each side of the vertical web, on each of the sideframe ends. More specifically, the rear pedestal of each pedestal jaw is structurally connected to the sideframe lower tension member, while the pedestal jaw roof is structurally connected to the sideframe upper compression member. In this way, each end of the sideframe is prevented from twisting such that all of the above-mentioned objects are satisfied.

BRIEF DESCRIPTION OF THE DRAWINGS

Other objects and advantages of the present invention will become apparent from the following detailed descriptions taken in conjunction with the drawings wherein;

FIG. 1 is a perspective view of a prior art railway truck;

FIG. 3 is a cross-sectional view of the sideframe of FIG. 2, at line A—A detailing the primary bracing means added to the pedestal jaw area;

FIG. 4 is a cross-sectional view of the sideframe of FIG. 2, at line B—B detailing the secondary bracing means to the pedestal jaw area;

FIG. 5 is a partial side view of a prior art sideframe showing the general arrangement around the pedestal jaw area without the bracing of the present invention;

DESCRIPTION OF THE PREFERRED EMBODIMENT

Figure 2:
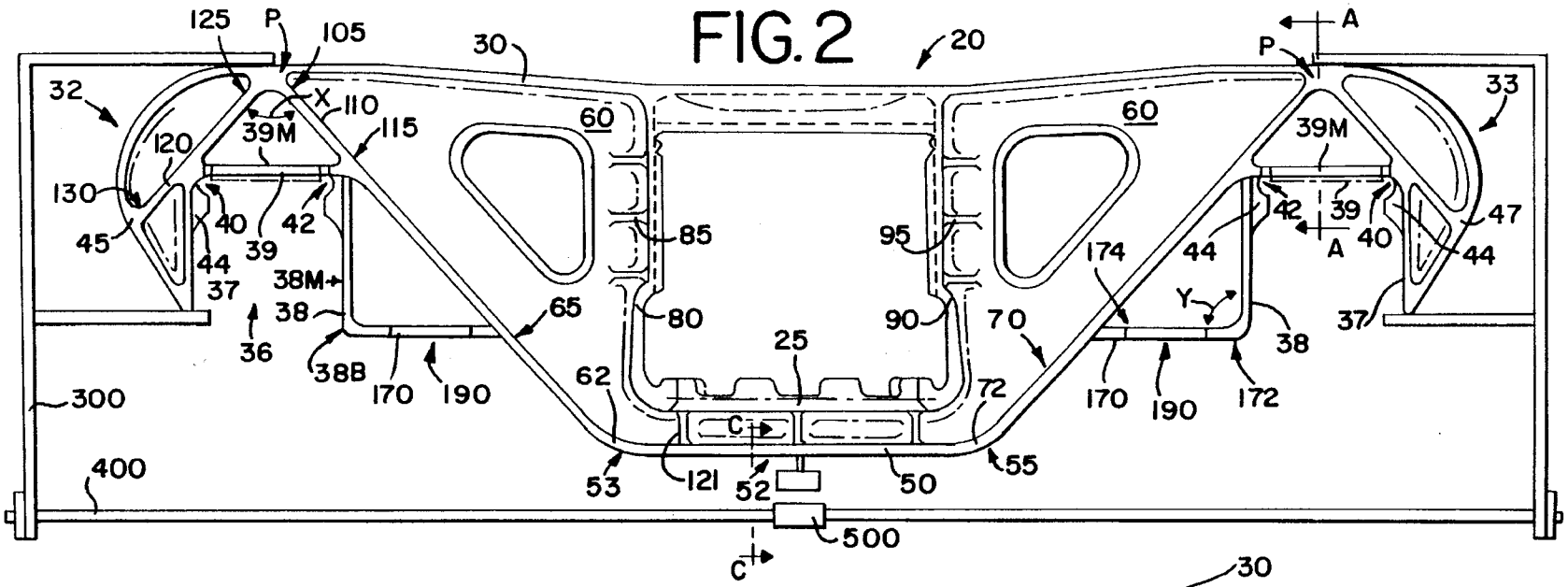
FIG. 2 is a side view of a sideframe of the present invention showing one embodiment of the bracing means which decreases twisting of each pedestal jaw.

Referring now to FIG. 1 there is shown a railway vehicle truck 10 common to the railroad industry. Truck 10 generally comprises a pair of longitudinally spaced wheel sets 12, each set including an axle 18 with laterally spaced wheels 22 attached at each end of the axles 18 in the standard manner. A pair of transversely spaced sideframes 20,24 are mounted onto each of the wheel sets 12. Sideframes 20,24 each include an inboard side 29 and an outboard side 31 and a midsection that includes a bolster opening 26, respectively, in which there are supported by means of spring sets 14, a bolster 16. Bolster 16 extends laterally between each sideframe 20,24 and generally carries the weight of the railcar. Upon movement in the vertical direction, bolster 16 is sprung by spring sets 14 which are attached to a spring seat plate 25 at the bottom of sideframes 20,24. The bolster is of substantially standard construction and will not be discussed.

Referring now to FIGS. 2–4, a sideframe 20 incorporating the features of the present invention is shown and generally comprises a solid upper compression member flange 30 extending lengthwise of truck 10 and a solid lower tension member flange 50, also extending the length of truck 10. A solid, vertical web 60, having sides 60A and 60B extends between upper flange 30 and lower flange 50, connecting the flanges together and defining the overall structural shape of sideframe 20 as an I-beam. Reviewing FIG. 2 in more detail, it is seen that lower tension member flange 50 is actually a unitary member comprised of a central section 52 which is generally parallel to upper compression member 30, and a front and rear section which is comprised of respective upwardly extending solid diagonal arms 65,70. The central section 52 has a front end 53 and a rear end 55 which respectively merges with diagonal members 65,70 at respective first and second bend points 62,72 for integrally connecting the lower flange 50 to the upper flange 30 at each sideframe end and specifically at each downwardly depending pedestal jaw 32,33. Each pedestal jaw is a mirror image to the other, thus, only one will be described in detail. As seen, jaw 32 is comprised of a forward pedestal 37, a rearward pedestal 38 and a roof 39 that interconnects with each pedestal to form a pedestal jaw opening 36. The pedestal roof 39 has a midpoint 39M, which is interposed between the forward corner 40 of said opening, and said rearward corner 42. As FIG. 1 illustrates each pedestal jaw opening 36 receives a wheeled axle 18 on which a bearing assembly 17 rotates. Each of the pedestal jaws include a respective bearing thrust lug 44 on each pedestal for retaining bearing 17 in a centered position within pedestal jaw opening 36.

Vertical columns 80,90 extend downwardly from top flange member 30 to spring seat plate 25, thereby forming a U-shaped center structure. Since each of the columns 80,90 are integrally connected to upper flange member 30, the spring seat plate 25 is effectively suspended in a fashion similar to a simply supported beam having an intermediate load. In order to provide lateral stability and strength to the columns 80,90, and spring seat plate 25, lower support struts 121 directly tie plate 25 to vertical web 60 and lower flange 50.

Operationally, the top flange member 30 undergoes compressive loading, while the bottom flange 50 undergoes a tensile loading. The sideframe U-shaped midsection structure experiences the greatest magnitude of forces since each sideframe and jaw end 32,33 is supported by the axles 18 and wheelsets 22, thereby effectively suspending the midsection between two "fixed" ends. This means that static and dynamic loading, as well as twisting and bending moments will be the greatest in the midsection area. The sideframe midsection therefore has to be structurally stronger than the distal pedestal jaw ends 32,33, therefore, the midsection is provided with struts 121 and reinforcing ribs 85, 95 to resist twisting. The spring plate 25 is also provided with a substantial thickness so that it offers additional resistance to twisting. At the very distal ends of each sideframe, namely at the pedestal jaw tips 45,47, the stresses are mainly vertically-directed static loads which happen to be the lowest in magnitude since the axles receive almost all the loading. When the truck becomes out of square, as in turning, the pedestal jaw area will also experience some lateral or transverse loading. Although open I-beam structures are known to offer excellent resistance to static and bending forces, the open I-beam structures are not particularly well suited for resisting transverse or twisting forces. FIG. 5 shows half of a prior art sideframe, where it is seen that the concerned sideframe jaw area is only provided with meager anti-twisting means in the form of gussets 56. The present invention is concerned with providing a sideframe which offers enhanced resistance to the twisting forces operating at the tips 45,47. To combat the end twisting, each pedestal jaw is tied, or cross-braced such that the top and bottom members 30,50, and the pedestal jaw are interconnected by a cross-bracing means which consists of a primary bracing means and a secondary bracing means, which will be described in greater detail shortly.

Because the primary and secondary bracing means increase the overall lateral strength of the I-beam shaped sideframe, the structural strength of the sideframe is increased in such a way that the midsection of the sideframe does not have to be as structurally reinforced as a non-braced sideframe. This means that metallic mass can actually be removed from the spring seat plate 25 by casting it thinner, without sacrificing the structural strength of the plate or the sideframe since the plate is a rather substantial member for handling the bending moments created by the spring sets. It should be realized that even though mass has been added to the sideframe in the form of the primary and secondary cross-bracing means, the removal of metallic mass from spring plate 25 still accounts for at least 25 pounds of net additional weight savings.

Figure 2A:
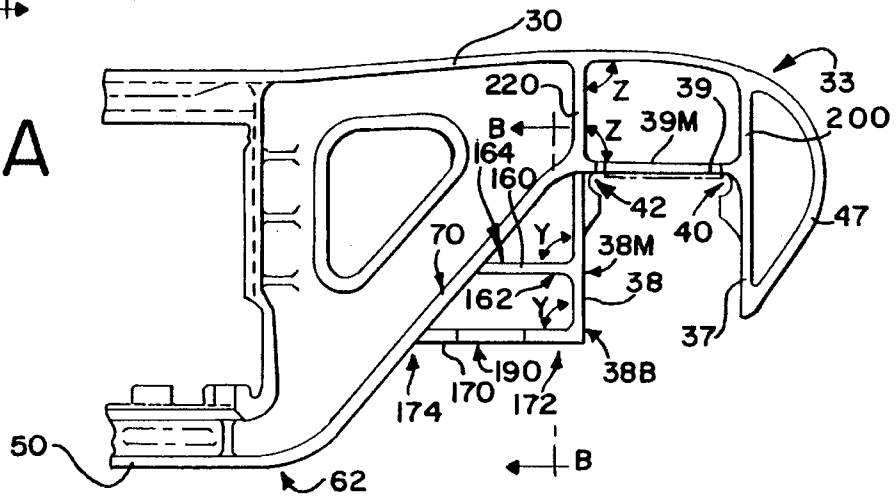
FIG. 2A is a side view of one sideframe end showing a second embodiment of the present invention.

In FIG. 2, attention should be drawn to each pedestal jaw 32,33, where the first embodiment of the present invention will be seen, while in FIG. 2A, only jaw 33 will be shown incorporating the second embodiment of the present invention. It will be understood from the following description that the first and second embodiments have a commonly constructed secondary bracing means in each embodiment.

The primary bracing means of the first embodiment at 32 and 33 is generally comprised of a L-shaped bracket having a foot 110 and a leg 120. The foot 110 includes a toe end 115 and a heel end 105, wherein the toe end 115 is integrally connected to lower tension member 50 and pedestal roof 39, generally at pedestal jaw rearward corner 42. Heel end 105 is integrally connected to upper compression member 30 at a point "P", which generally corresponds to a location directly above the longitudinal midpoint 39M of pedestal roof 39. FIG. 2 also illustrates that bottom end 125 of leg 120 is also connected to upper member 30 and foot 110 at the same point P. Alternatively, top end 130 of leg 120 is integrally connected to the tip 45 of pedestal jaw 32. It is also seen that leg and foot portions 110,120, form an angle "X" which is preferably any acute angle which will allow leg portion 120 to touch and integrally join pedestal roof 39 generally at a pedestal jaw forward corner 40. In this way, each pedestal jaw corner 40,42 is structurally joined to each side 60A,60B of sideframe web 60 and to upper and lower flanges 30,50, thereby causing each pedestal jaw to exhibit excellent twisting resistance characteristics. FIG. 3 illustrates the cross section through the primary cross-bracing means, taken along line A—A of FIG. 2, where it is seen that the top flange 30 is structurally reinforced around point P due to members 110 and 120 joining there. It should be noted that the cross-sectional thickness of the remainder of top flange 30 is structurally unaffected and the dashed line representation incorporated into flange 30 in this view represents the normal thickness of the flange beyond point P. FIG. 3 further illustrates that the width of leg 120 does not extend beyond the lateral extent of either of the upper or lower members 30 or 50, and although the foot 110 portion of the primary bracing means is not shown in FIG. 3, it should be emphasized that the width of this member does not extend beyond the lateral extent of the width of members 30,50 either. FIG. 3 further illustrates that the primary bracing means is located on each side of the sideframe such that each side, 60A and 60B of vertical web 60, is integrally connected to the primary bracing means.

In the second embodiment of the present invention shown in FIG. 2A, the primary bracing means at jaw 33 is comprised of a first and a second longitudinally displaced post 200,220, each of which simultaneously connects the pedestal jaw to the upper compression member 30 and the lower tension member 50. Both sides of the sideframe are constructed with said posts such that each side 60A and 60B of vertical web 60 will be integrally connected to the primary bracing means. Each post is vertically disposed such that one end of the post is anchored to the pedestal jaw roof 39 at a respective forward pedestal jaw corner 40 and a rearward corner 42, while the other end of each post is connected to the upper compression member 30. When connecting said posts, it is desirable that each post form a substantially right angle "Z" between the respective post 200,220 and the pedestal roof 39. This orientation necessarily dictates that the same angle "Z" will be formed at the connection of the post with the upper compression member 30. FIG. 2A also illustrates that in order to maximize the effectiveness of each post, they should preferably be in vertical alignment with their respective pedestal, 37 or 38. Thus, it is seen that first post 200 and forward pedestal 37 are vertically aligned, while post 220 is vertically aligned with rearward pedestal 38. The second post 220 is also seen as being joined to the lower tension member at the rearward corner 42. By joining post 220 at corner 42, additional twisting resistance is gained over a pedestal jaw having a second post positioned laterally closer to the pedestal roof midpoint. This is due to the synergistic effect of having the primary bracing means and the secondary bracing means joining at corner 42; the secondary bracing means will be described immediately below. This same synergistic effect is also realized with the primary bracing means of the first embodiment, where inspection of jaw 32 shows the leg 120 being simultaneously connected at corner 42 to the pedestal roof 39 and lower member 50.

As mentioned earlier, a secondary bracing means is common to each of the embodiments of the present invention, and it is constructed exactly the same for each embodiment. FIG. 2 shows that the secondary bracing means is comprised of a horizontally disposed joist 170 which extends between pedestal jaw rearward pedestal 38 and rear upwardly extending arm 70 of lower member 50. Joist 170 has one end 172 integrally connected to the bottom end 38B of rearward pedestal 38, while the other end 174 is integrally connected to lower tension member 50. The joist 170 and pedestal 38 preferably form angle "Y", which is substantially a right angle. A lightener hole 190 can be added to joist 170 to reduce the amount of mass added to the pedestal jaw if desired; the size of the hole determined by well-known engineering principals.

FIG. 2A shows that a second horizontal joist can be added as part of the secondary bracing means if desired, and this second joist member is illustrated at 160, displaced a short vertical distance above joist 170. Second or upper joist 160 is integrally connected at one end 162 to the horizontal midsection 38M of rearward pedestal 38, while the other end 164 is integrally connected to lower tension member 50. FIG. 4 is a cross sectional view taken along line B—B of FIG. 2, illustrating that both joists are included as part of the secondary bracing means. This figure emphasizes that each horizontal joist 160, 170 has a width or lateral extent which is substantially equal to the width or lateral extent of the diagonal arm 70 of lower tension member 50 at the point where each respective joist connects with the lower member. Since the lower member 50 is actually decreasing in width between first bend point 62 and rearward pedestal corner 42, it should be clear that joist 170 will be slightly wider than upper joist 160, and it will also be longer in longitudinal extent since the span between lower tension member 50 and pedestal bottom 38B is greater than the span between member 50 and pedestal midsection 38M. Like brace 170, brace 160 forms the same angle "Y" where it joins pedestal 38 at midpoint 38M, the angle being substantially a right angle. FIG. 4 emphasizes that the joist(s) of the secondary bracing means are secured across the entire lateral extent or width of the diagonal arm 70 of lower member 50. Although not shown in that same illustration, it should be clear that each joist end 162,172 would also be as wide as the width of the rearward pedestal 38.

It should also be emphasized that the secondary bracing means is an important aspect of the present invention which must be used in connection with the primary means, or else without it, sideframe 20 would still be susceptible to twisting and failure of the AAR tests. If only a primary bracing means were provided, the pedestal jaw area from the rearward pedestal 38, to either of the vertical columns 80 or 90, would essentially receive all of the laterally directed forces, since the tip 47 would be braced to resist them. Bracing only the tip 47 would cause the forces to twist the sideframe between pedestal 38 and column 80 or 90, thereby creating susceptibility to test failures. Therefore, it should be understood that both the primary and secondary bracing means are simultaneously required in order to carry forth the best mode of the present invention. Furthermore, both bracing means will ensure that the test equipment specified by the AAR will not be allowed to flexure during testing, thereby allowing a consistent and true measure of transverse sideframe static deflection.

In addition, it is preferable that the primary and secondary bracing means be constructed so as to maintain the "open" feature of both sides of the sideframe. By that it is meant that the I-beam shaped sideframe ends 32,33 could have been attached around the perimeter of each pedestal jaw, on each inboard and outboard side of the sideframe so as to literally "box-in" each of the pedestal jaw areas. Although this approach would strengthen each of the pedestal jaw areas as desired, this method would defeat the desired purpose of retaining an "open" sideframe so that every part of the sideframe can be visually inspected for cracks, etc. Enclosing each end would also be more expensive to install and require expensive non-destructive testing in order to inspect each end.

The foregoing description has been provided to clearly define and completely describe the present invention. Various modifications may be made without departing from the scope and spirit of the invention, which is defined in the following claims.

What is claimed is:

1. An improved lightweight railcar truck sideframe of a generally solid and open, I-beam cross-sectional shape for carrying a railcar payload, said sideframe having a longitudinal axis, a front end, a back end and a midsection therebetween, a longitudinally elongate solid upper compression member having a first end and a second end, each of said ends including a respective pedestal jaw downwardly depending therefrom, each of said pedestal jaws formed by a vertically disposed forward pedestal, a vertically disposed rearward pedestal and a horizontally disposed pedestal roof interconnecting said forward and rearward pedestals, each of said pedestal jaws including a forward corner and a rearward corner, said corners formed at the intersection of a respective pedestal and said roof, said pedestal roof including a midpoint between said forward and rearward corners, a longitudinally elongate solid lower tension member having a front section, a rear section and a central section therebetween, said central section having a proximal and distal ends, each of said sections integrally formed such that said central section is disposed generally parallel to said upper compression member, while said front section upwardly extends as a solid diagonal arm from said center section proximal end to said upper compression member first end, and said back section upwardly extends as a solid diagonal arm from said center section distal end to said upper compression member second end, each of said diagonal arms extending upwards to and connecting with a respective upper compression member end at a respective pedestal jaw, a substantially solid vertical web having an inboard side and an outboard side, said inboard and outboard sides defining an inboard and outboard side of said sideframe, said web including a bolster opening about said sideframe midsection which defines a front vertical column and a rear vertical column, said sideframe I-beam cross-sectional shape defined by a solid top flange corresponding to said upper compression member, a solid bottom flange corresponding to said lower tension member, and said substantially solid vertical web interconnecting said upper and lower flanges, said improvement comprising:

said sideframe front and rear ends being structurally reinforced with bracing means on each of said sideframe sides at each of said pedestal jaws in order to increase the lateral stiffness of said sideframe while decreasing succeptability to structural sideframe twisting, said bracing means comprised of a primary bracing means and a secondary bracing means, said primary bracing means connecting said pedestal jaw roof to said top compression member and said secondary bracing means connecting said rearward pedestal to said lower tension member, wherein said pedestal jaw is simultaneously connected to said upper and lower members on each side of said sideframe, wherein said primary bracing means is comprised of a generally L-shaped bracket interconnecting said pedestal jaw roof to said upper compression member, said lower tension member, and said vertical web, said primary bracing means having a foot and a leg, said foot including a toe end and a heel end and said leg including a bottom end and a top end, said heel end of said foot connected to said bottom end of said leg, said heel end and said leg bottom end joined to said upper compression member at the same location, wherein said secondary bracing means includes at least one horizontally disposed joist, said joist disposed such that said rearward pedestal and said joist form a substantially right angle when connected, wherein said secondary bracing means connects one of said lower tension member front and rear arms to said rearward pedestal of said pedestal jaw, said second bracing means coextensive with said rearward pedestal at said pedestal jaw and with said bottom tension member at said arm.

2. The sideframe of claim 1 wherein said primary bracing means is comprised of a first and a second vertically disposed post, each of said posts connecting said pedestal jaw roof to said upper compression member, said lower tension member and said vertical web, said first post attached at said forward corner and said second post attached at said rearward corner.

3. The sideframe of claim 2 wherein said second post is connected to said lower tension member, and said pedestal jaw at said rearward corner.

4. The lightweight sideframe of claim 1 wherein said secondary bracing means includes a lightener hole.

5. The lightweight sideframe of claim 1 wherein each of said L-shaped bracket forms a right angle between said foot and said leg, said heel end of said foot and said bottom end of said leg both attached to said upper compression member at a point which is generally above said longitudinal midpoint of said pedestal jaw roof, said top end of said leg attached to said tip of said pedestal jaw while a part of said leg between said top and bottom ends is connected to said forward corner of said pedestal jaw, said toe end of said foot attached to said pedestal jaw rearward corner and to said lower compression member.

6. A railway car truck of relatively light weight for carrying a railcar payload, said truck having a longitudinal axis and including a pair of laterally spaced sideframes with wheeled axles mounted therebetween, each of said sideframes having an inboard side and an outboard side, a front end, a rear end and a midsection, each of said front and rear ends including a respective downwardly depending pedestal jaw for receiving said axle therein, said midsection defining a bolster opening which accepts a transversely extending bolster for connecting said sideframes together, each of said pedestal jaws formed by a forward vertical pedestal, a rearward vertical pedestal, and a horizontal pedestal roof interconnecting said pedestals, said rearward pedestal having a bottom end, each of said sideframes having a generally solid, I-beam cross sectional construction defined by a solid top flange, a solid bottom flange, and a substantially solid vertical web interconnecting said top and bottom flanges, each of said sideframe ends being structurally reinforced with bracing means at said front and rear pedestal jaws for increasing lateral stiffness and resistance to structural twisting of said sideframe, while increasing resistance to high speed truck hunting, said bracing means attached to each of said sideframe sides and including a primary bracing means and a secondary bracing means, said primary bracing means connecting said pedestal jaw to said top flange and said secondary bracing means connecting said pedestal jaw to said bottom flange, wherein said primary means is comprised of an L-shaped bracket, said bracket connecting said pedestal jaw roof to said top flange, said bottom flange and said vertical web, said L-shaped bracket formed by a foot and a leg, said foot including a toe end and a heel end, said leg including a top end and a bottom end, said heel of said foot connected to said bottom end of said leg, said heel and said bottom end of said leg both joined to said top flange at the same location, said location being generally centered between said forward and rearward pedestals, and wherein said secondary bracing means is comprised of at least one horizontally disposed joist, said joist interconnecting said rearward pedestal to said bottom flange, said joist connected to said bottom end of said rearward pedestal.

7. The railway truck of claim 6 wherein said primary bracing means is comprised of a first and a second vertically disposed post, said posts longitudinally displaced from each other such that said first post is adjacent said forward pedestal and said second post is adjacent said rearward pedestal, each of said posts connecting said pedestal roof to said top flange, said bottom flange and said vertical web.

* * * * *